US005968705A

United States Patent [19]

Yamada et al.

[11] Patent Number: 5,968,705

[45] Date of Patent: Oct. 19, 1999

[54] PROCESS FOR PRODUCING A POLYMERIZED TONER

[75] Inventors: Ikuo Yamada; Hiroshi Yamamoto, both of Tokuyama, Japan

[73] Assignee: Nippon Zeon Co., Ltd., Tokyo, Japan

[21] Appl. No.: 09/082,185

[22] Filed: May 21, 1998

[30] Foreign Application Priority Data

May 23, 1997 [JP] Japan ..... 9-150147

[51] Int. Cl.[6] ..... G03G 9/087

[52] U.S. Cl. ..... 430/137

[58] Field of Search ..... 430/137

[56] References Cited

U.S. PATENT DOCUMENTS 5,346,790 9/1994 Sacripante et al. ..... 430/137
5,549,998 8/1996 Georges et al. ..... 430/137

FOREIGN PATENT DOCUMENTS 0 524 016 A1 1/1993 European Pat. Off. .
5-19534 1/1993 Japan .
5-34979 2/1993 Japan .

*Primary Examiner*—Roland Martin
*Attorney, Agent, or Firm*—Armstrong, Westerman, Hattori, McLeland & Naughton

[57] ABSTRACT

An object of the present invention is to provide a process for producing stably a polymerized toner having excellent balance of shelf stability and fixability, and high resolution visible image formation. The process for producing a polymerized toner comprising a step of raising the temperature of an aqueous dispersion of monomer composition comprising a colorant, a polymerization initiator such as t-butyl peroxy-2-ethylhexanoate and a polymerizable monomer component such as styrene to a temperature lower than a target polymerization temperature by about 10 to about 40° C., a step of raising the temperature of the dispersion at the rate of about 1 to about 20° C. an hour to a temperature lower than the target polymerization temperature by about 5° C., and a step of raising the temperature of the dispersion at the rate of about 3 to about 10° C. an hour to the target polymerization temperature, whereby the polymerizable monomer component is polymerized.

20 Claims, 3 Drawing Sheets

PROCESS FOR PRODUCING A POLYMERIZED TONER

FIELD OF THE INVENTION

This invention relates to a process for producing a polymerized toner, and more particularly to a process for producing a polymerized toner for development of an electrostatic latent image obtained by an electrophotographic method or an electrostatic recording method.

DESCRIPTION OF THE RELATED ART

An electrostatic latent image formed with a visible image forming apparatus, such as an electrophotographic apparatus or an electrostatic recorder, has been developed with a toner to obtain a visible image on photosensitive material. The visible image has been transcribed onto a transcription sheet such as a paper or a resin sheet for an Overhead Projector (OHP), and fixed on the sheet by heating, pressing, treating with a solvent vapor or so on.

A pulverized toner, which is obtained by adding a colorant and other material into melted resin, solidifying the resin, pulverizing to granulate the resin, and classifying the resin particle was mainly used in the visible image forming apparatus. Recently, savings in electric power cost, higher speed duplicating or higher speed printing, and higher resolution visible image are demanded in an electrophotographic apparatus. So, attention has been directed to a polymerized toner obtained by polymerization of a monomer composition containing a colorant.

As a process for producing a polymerized toner, a known process comprises a step of dispersing a monomer composition which comprises a colorant, a polymerization initiator and a polymerizable monomer component in an aqueous dispersion medium containing a surfactant and an inorganic colloid dispersant such as calcium phosphate, and a step of heating it to a target temperature for polymerization of the polymerizable monomer component. In this process, the aqueous dispersion of monomer composition is heated by setting the jacket temperature of a polymerization reactor to the target temperature for polymerization. The temperature of the aqueous dispersion of monomer composition does not necessarily reach the target polymerization temperature even if the jacket temperature is set to the target polymerization temperature, and follows a variety of temperature profiles for each batch. Therefore, the toner obtained in each batch often has various properties. Also, the toner obtained by the above process has an insufficient balance of shelf stability and fixability, and is not satisfactory for high speed image forming.

SUMMARY OF THE INVENTION

An object of the present invention is to provide a process for producing stably a polymerized toner having excellent balance of shelf stability and fixability, and high resolution visible image formation.

The present inventors made a study in order to achieve the above object and found that the object can be accomplished by controlling the temperature for polymerization of the polymerizable monomer component so as to trace the specific temperature profile of an aqueous dispersion of monomer composition.

In one aspect of the present invention, there is provided a process for producing a polymerized toner comprising a step of raising the temperature of an aqueous dispersion of monomer composition to a temperature lower than a target polymerization temperature by about 10° C. to about 40° C., in which the monomer composition comprises a colorant, a polymerization initiator and a polymerizable monomer component; a step of raising the temperature of the aqueous dispersion at the rate of about 1° C. to about 20° C. an hour to a temperature lower than the target polymerization temperature by about 5° C.; and a step of raising the temperature of the aqueous dispersion at the rate of about 3° C. to about 10° C. an hour to the target polymerization temperature, whereby the polymerizable monomer component is polymerized.

In a preferred embodiment of the present invention, there is provided a process for producing a polymerized toner comprising a step of raising the temperature of an aqueous dispersion of monomer composition to a temperature lower than a target polymerization temperature by about 10° C. to about 40° C., in which the monomer composition comprises a colorant, a polymerization initiator and a polymerizable monomer component; a step of raising the temperature of the aqueous dispersion at the rate of about 3° C. to about 10° C. an hour to a temperature lower than the target polymerization temperature by about 5° C.; and a step of raising the temperature of the aqueous dispersion at the rate of about 5° C. to about 8° C. an hour to the target polymerization temperature, whereby the polymerizable monomer component is polymerized.

In a preferred embodiment of the process for producing the polymerized toner, a step of controlling the temperature of the aqueous dispersion of the monomer composition within ±5° C. of the target polymerization temperature after reaching a temperature lower than the target polymerization temperature by about 5° C. is further included.

In another preferred embodiment of the process for producing the polymerized toner, the polymerization is carried out in the presence of a dispersant.

In another preferred embodiment of the process for producing the polymerized toner, the dispersant comprises a colloid of a water-insoluble metal hydroxide.

In another preferred embodiment of the process for producing the polymerized toner, the dispersant comprises a colloid of a water-insoluble metal hydroxide having a particle size at 50 percent of the cumulative number distribution of particle size of not more than 0.5 micrometer, and having a particle size at 90 percent of the cumulative number distribution of particle size of not more than 1 micrometer.

In another preferred embodiment of the process for producing the polymerized toner, the dispersant comprises a colloid of a water-insoluble metal hydroxide obtained by bringing to a value of not less than 7 the pH of an aqueous solution of a water-soluble multivalent metal compound.

In another preferred embodiment of the process for producing the polymerized toner, the dispersant comprises a colloid of a water-insoluble metal hydroxide obtained by reacting a water-soluble multivalent metal compound with an alkali metal hydroxide in a water phase.

In another preferred embodiment of the process for producing the polymerized toner, the polymerizable monomer component contains a mono-vinyl monomer and a crosslinkable monomer.

In another preferred embodiment of the process for producing the polymerized toner, the polymerizable monomer component contains a mono-vinyl monomer, a crosslinkable monomer and a macro-monomer.

In another preferred embodiment of the process for producing the polymerized toner, the mono-vinyl monomer is selected from the group consisting of styrene, acrylic acid, methacrylic acid, and a derivative thereof.

In another preferred embodiment of the process for producing the polymerized toner, the mono-vinyl monomer is a mixture of styrene and n-butyl acrylate, a mixture of styrene and 2-ethyl hexyl acrylate, or a mixture of styrene, n-butyl acrylate and 2-ethyl hexyl acrylate.

In another preferred embodiment of the process for producing the polymerized toner, the macro-monomer has an acrylyl group or a methacrylyl group at the end of the molecular chain.

In another preferred embodiment of the process for producing the polymerized toner, the macro-monomer is a polymer or a copolymer of methacrylate or acrylate.

In another preferred embodiment of the process for producing the polymerized toner, the macro-monomer has a molecular weight of about 1,000 to about 30,000.

In another preferred embodiment of the process for producing the polymerized toner, the amount of the macro-monomer is 0.01 to 10 parts by weight based on 100 parts by weight of the mono-vinyl monomer.

In another preferred embodiment of the process for producing the polymerized toner, the polymerization initiator is an oil-soluble radical polymerization initiator.

In another preferred embodiment of the process for producing the polymerized toner, the oil-soluble radical polymerization initiator is an organic peroxide having a molecular weight of not more than 250 and a temperature at a half-life period of 10 hours of 40 to 80 degrees centigrade.

In another preferred embodiment of the process for producing the polymerized toner, the polymerization initiator is t-butyl peroxy-2-ethylhexanoate.

In another preferred embodiment of the process for producing the polymerized toner, the amount of the polymerization initiator is 0.1 to 20 parts by weight based on 100 parts by weight of the mono-vinyl monomer.

In another preferred embodiment of the process for producing the polymerized toner, the monomer composition comprises a colorant, a polymerization initiator, a polymerizable monomer component and an electric charge control agent.

In another preferred embodiment of the process for producing the polymerized toner, in which the aqueous dispersion of monomer composition is obtained by dispersing a monomer mixture containing the polymerizable monomer component and the colorant other than the oil-soluble polymerization initiator in an aqueous dispersion medium containing the dispersant, adding the oil-soluble polymerization initiator to the dispersion of the monomer mixture while stirring the dispersion of the monomer mixture to form primary droplets of the monomer mixture, thereby bringing the primary droplets into contact with droplets of the oil-soluble polymerization initiator to form secondary droplets of the monomer composition containing the oil-soluble polymerization initiator, the polymerizable monomer component and the colorant, and further conducting the stirring to form secondary droplets having desired droplets sizes.

DETAILED DESCRIPTION OF THIS INVENTION

Figure 1:
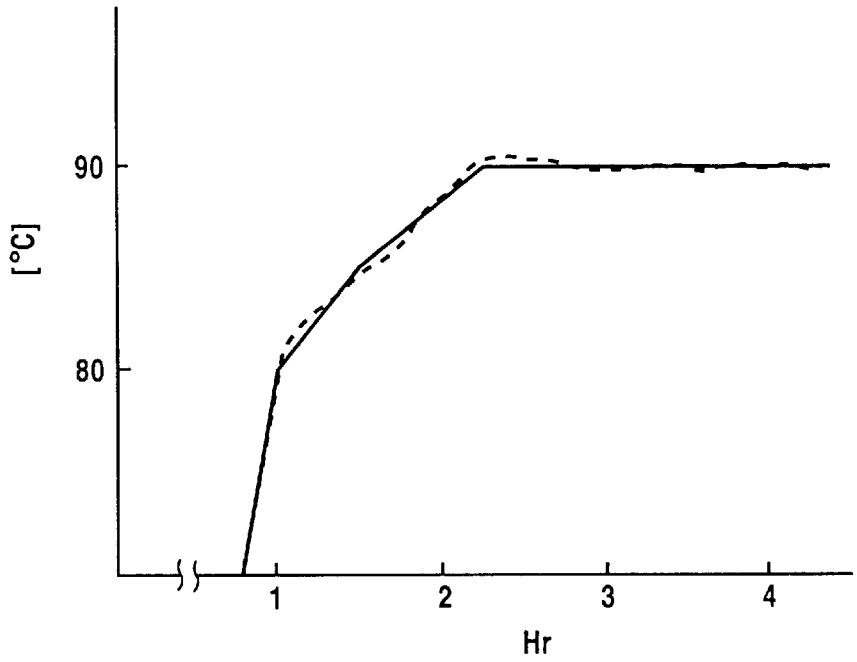
FIG. 1 illustrates a temperature profile of an aqueous dispersion of monomer composition at the 5th batch of Example 1.

A process for producing a polymerized toner of the present invention comprises steps of raising the temperature of an aqueous dispersion of a monomer composition to a temperature lower than a target polymerization temperature by about 10 to about 40° C.; raising the temperature of the aqueous dispersion of monomer composition at the rate of about 1° C. to about 20° C. an hour to a temperature lower than the target polymerization temperature by about 5° C.; and raising the temperature of the aqueous dispersion of monomer composition at the rate of about 3° C. to about 10° C. an hour to the target polymerization temperature, whereby the polymerizable monomer component is polymerized.

The monomer composition used in the present invention comprises a colorant, a polymerization initiator and a polymerizable monomer component.

The polymerizable monomer component comprises at least one mono-vinyl monomer and preferably at least one crosslinkable monomer.

As the mono-vinyl monomer used in the present invention, examples are styrene derivative monomers such as styrene, vinyltoluene, α-methyl styrene; derivatives of acrylic acid or methacrylic acid such as acrylic acid, methacrylic acid, methyl acrylate, ethyl acrylate, propyl acrylate, butyl acrylate, 2-ethylhexyl acrylate, dimethyl amino ethyl acrylate, methyl methacrylate, ethyl methacrylate, propyl methacrylate, butyl methacrylate, 2-ethylhexyl methacrylate, dimethyl amino ethyl methacrylate, acrylonitrile, methacrylonitrile, acrylamide, methacrylamide; ethylenically unsaturated mono-olefin such as ethylene, propylene, butylene; halogenated vinyl monomer such as vinyl chloride, vinylidene chloride, vinyl fluoride; vinyl ester such as vinyl acetate, vinyl propionate; vinyl ether such as vinyl methyl ether, vinyl ethyl ether; vinyl ketone such as vinyl methyl ketone, methyl isopropenyl ketone; vinyl compounds containing nitrogen such as 2-vinyl pyridine, 4-vinyl pyridine, N-vinyl pyrrolidone; and so forth. These mono-vinyl monomers can be used either alone or in combination. Of these mono-vinyl monomers, styrene derivative monomers, or derivatives of acrylic acid or methacrylic acid can be preferably used.

A crosslinkable monomer is preferably used with the mono-vinyl monomer to enhance shelf stability. As the crosslinkable monomer, examples are aromatic divinyl compounds such as divinylbenzene, divinylnaphthalene, and derivatives thereof; di-ethylenically unsaturated carboxylates such as ethylene glycol di-methacrylate, di-ethylene glycol di-methacrylate; di-vinyl compounds such as N,N-divinyl aniline, di-vinyl ether; compounds having at least three vinyl groups and so on. These crosslinkable monomers can be used either alone or in combination. The amount of the crosslinkable monomer is usually in a range of 0.1 to 5 parts by weight, preferably 0.3 to 2 parts by weight, based on 100 parts by weight of the mono-vinyl monomer.

A macro-monomer used furthermore with the mono-vinyl monomer is preferable, since the balance of shelf stability and fixability is enhanced thereby. The macro-monomer is an oligomer or a polymer having polymerizable vinyl groups on the ends of the molecular chain and having a number average molecular weight of generally 1,000 to 30,000. If the number average molecular weight is too small, the surface of the polymer particle tends to become limp, and shelf stability tends to be reduced. If the number average molecular weight is too large, solubility of the macro-monomer tends to be reduced, and fixability tends to be reduced. As the polymerizable vinyl group on the ends of the molecular chain of the macro-monomer, there can be mentioned acrylyl group, methacrylyl group and so on. Methacrylyl group is preferable in view of co-polymerizability.

As the macro-monomer, examples are a polymer obtained by polymerizing a monomer, such as styrene, derivative of styrene, methacrylate, acrylate, acrylonitrile, methacrylonitrile and so forth, either alone or in combination; a macromonomer having a polysiloxane unit; a macro-monomer represented by the following chemical formulas (I)–(XII) (as disclosed in pages 4 to 7 of Japanese laid open patent application Tokukaihei 3-203746):

(I)

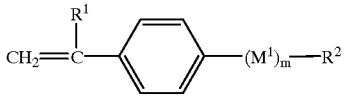

(II)

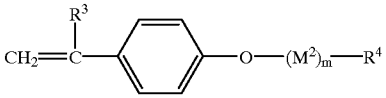

(III)

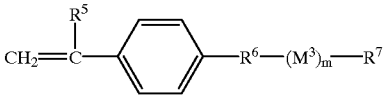

(IV)

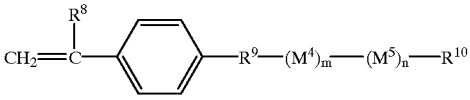

(V)

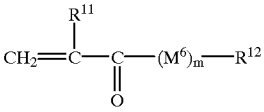

(VI)

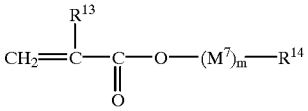

(VII)

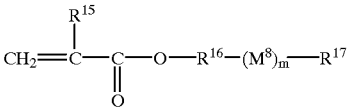

(VIII)

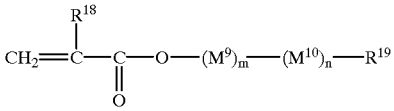

(IX)

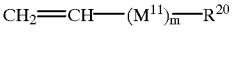

(X)

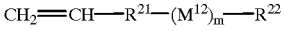

-continued (XI)

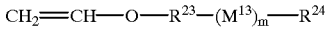

(XII)

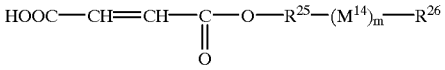

Where in $R^1$, $R^3$, $R^5$, $R^8$, $R^{11}$, $R^{13}$, $R^{15}$ and $R^{18}$ independently represent —H, alkyl group of C1 to C5 (including a branched alkyl group as tert-, sec- and the like);

$R^2$, $R^4$, $R^7$, $R^{10}$, $R^{12}$, $R^{14}$, $R^{17}$, $R^{19}$, $R^{20}$, $R^{22}$, $R^{24}$ and $R^{26}$ independently represent —H, an alkyl group of C1 to C10 (including a branched alkyl group as tert-, sec- and the like), —OH, an alkoxy group of C1 to C6 (for examples are

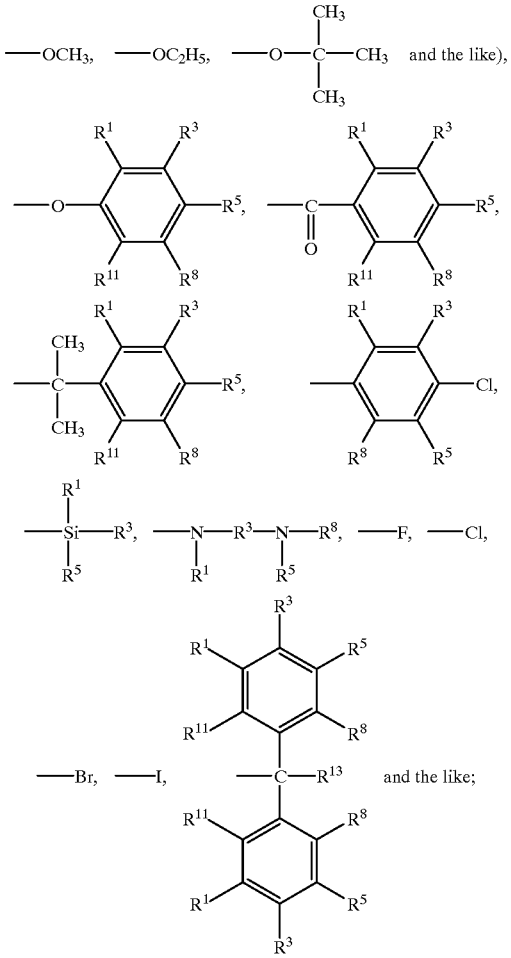

$R^6$, $R^9$, $R^{16}$, $R^{21}$, $R^{23}$, $R^{25}$ independently represent an alkyl group of C1 to C10, —$R^1$—O—, —O—$R^1$—, —$R^1$O$R^2$—,

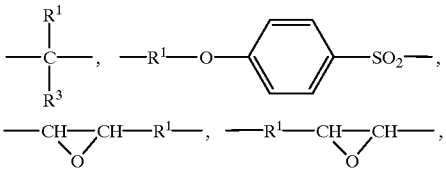

-continued
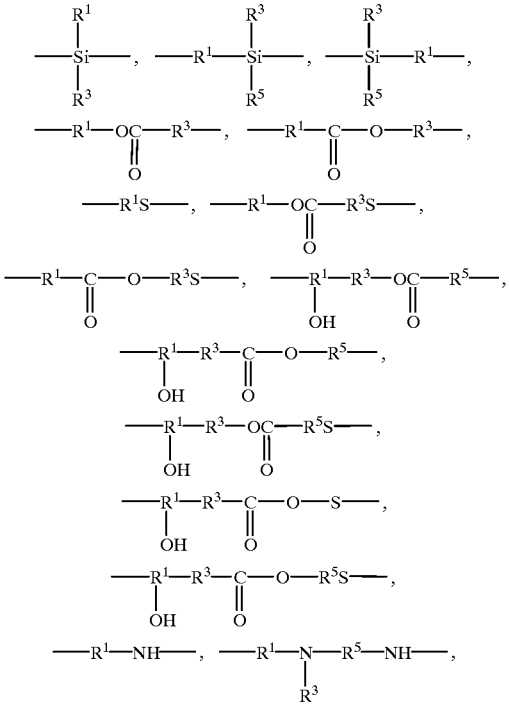
and the like;
$M^1$ to $M^{14}$ independently represent polymerizable monomer such as
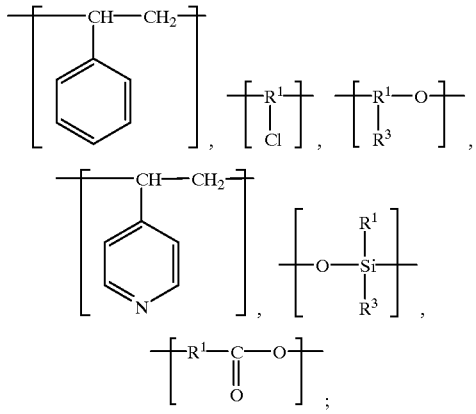
m and n independently represent an integer of 1 to 3,000.
The specific examples of the macromonomer are represented by the following chemical formula (1) to (59):
(1)
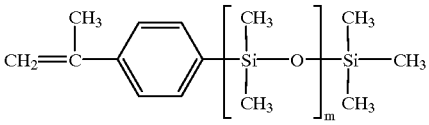
(2)
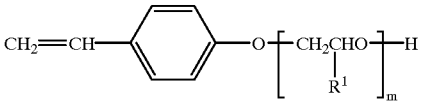
(3)
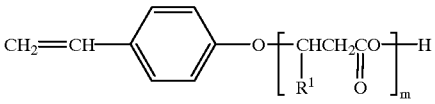
(4)
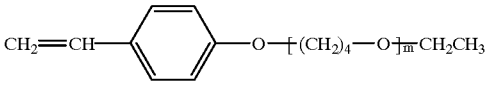
(5)
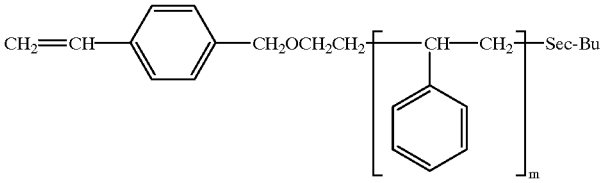

-continued
(6)
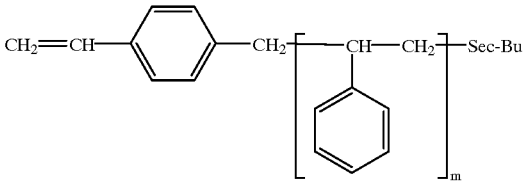
(7)
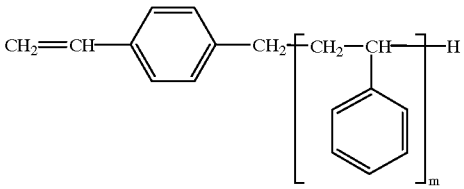
(8)
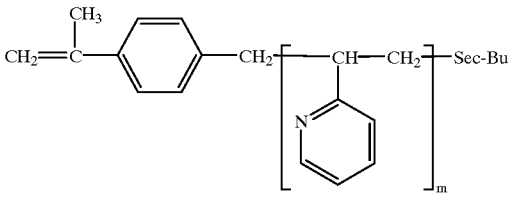
(9)
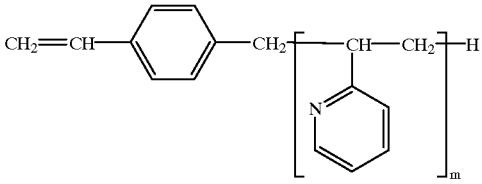
(10)
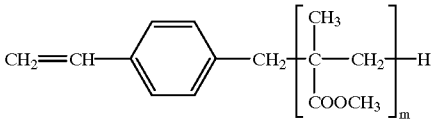
(11)
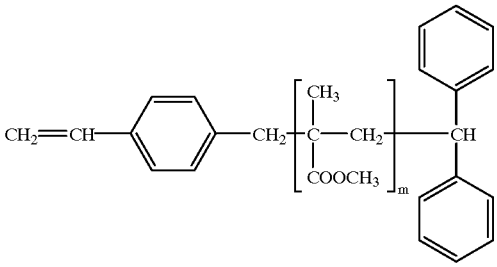
(12)
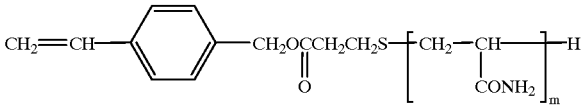
(13)
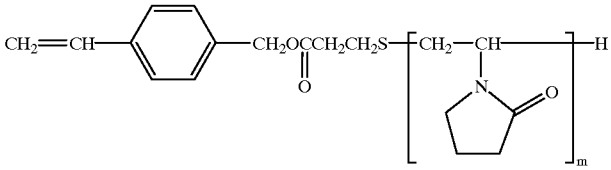

-continued
(14)
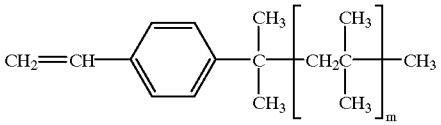
(15)
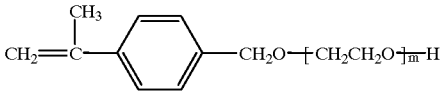
(16)
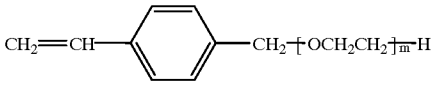
(17)
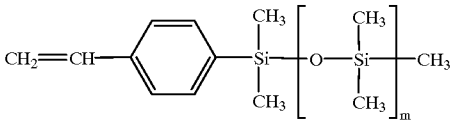
(18)
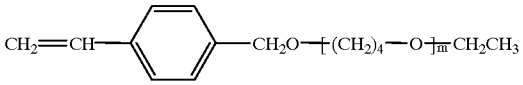
(19)
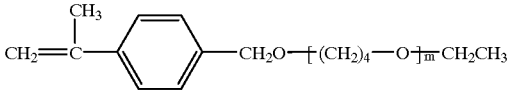
(20)
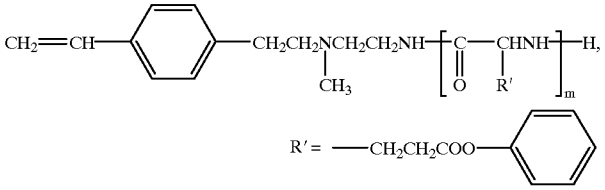
(21)
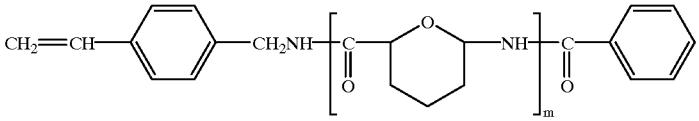
(22)
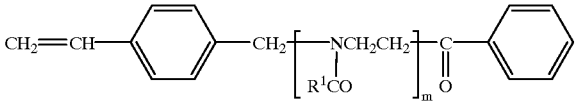
(23)
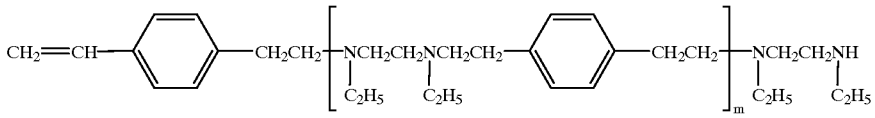
(24)
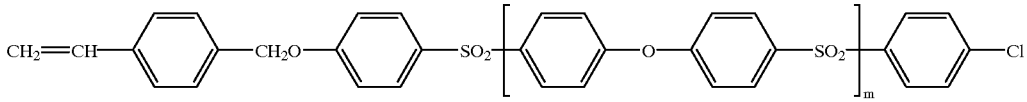

-continued
(25)
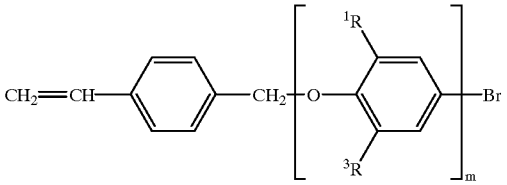
(26)
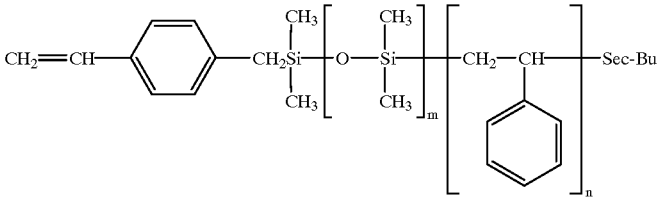
(27)
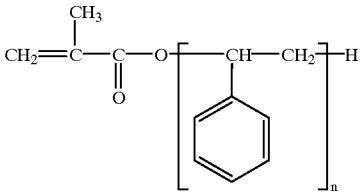
(28)
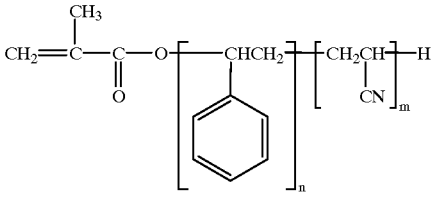
(29)
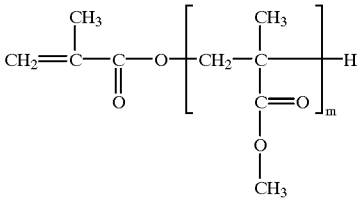
(30)
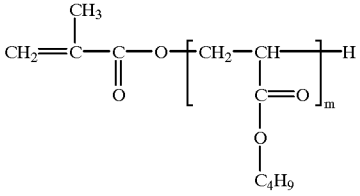
(31)
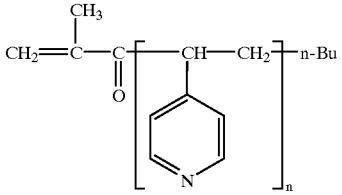

-continued
(32)
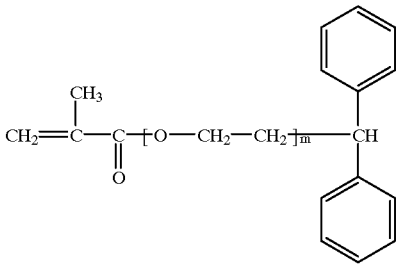
(33)
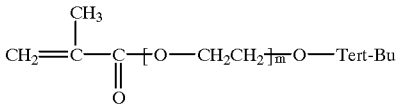
(34)
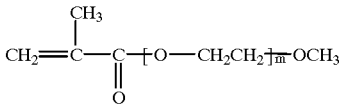
(35)
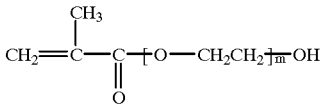
(36)
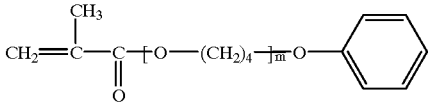
(37)
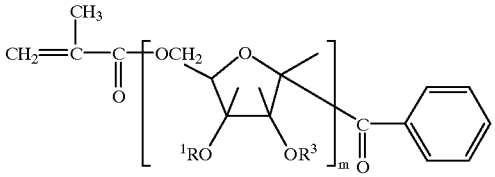
(38)
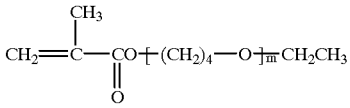
(39)
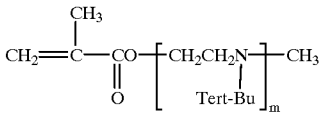
(40)
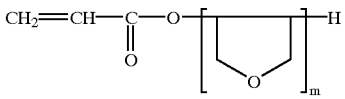
(41)
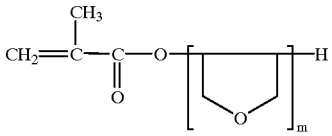

-continued
(42)
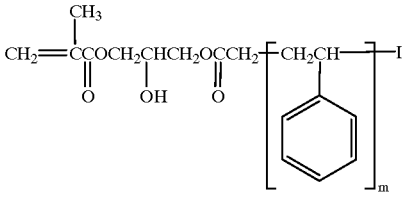
(43)
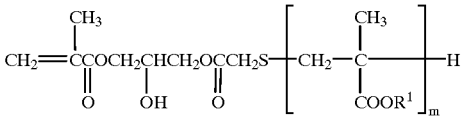
(44)
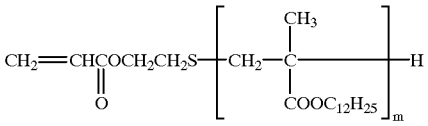
(45)
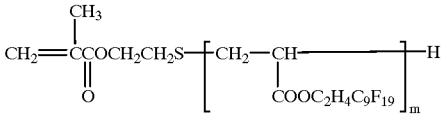
(46)
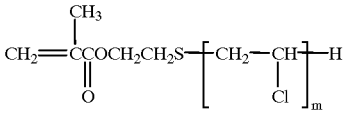
(47)
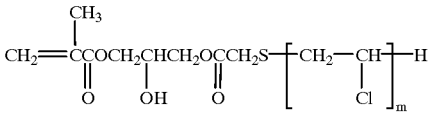
(48)
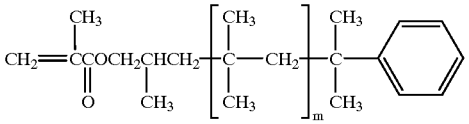
(49)
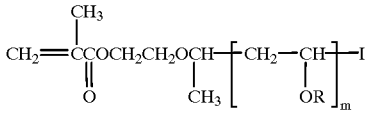
(50)
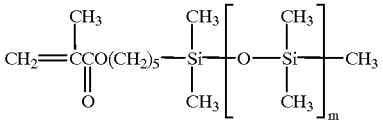
(51)
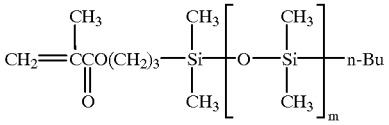

-continued (52)

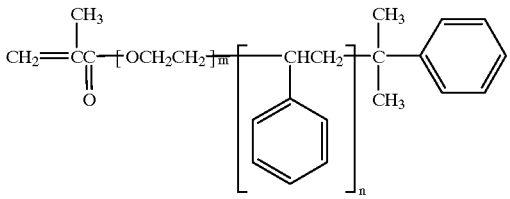

(53)

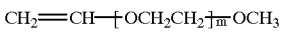

(54)

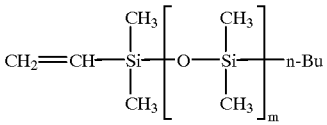

(55)

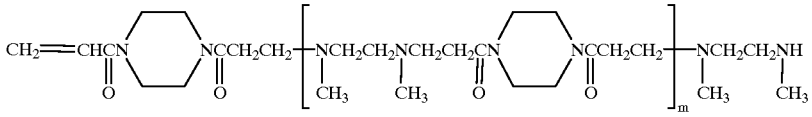

(56)

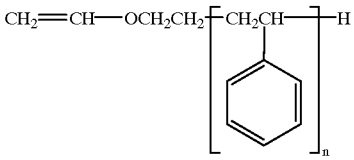

(57)

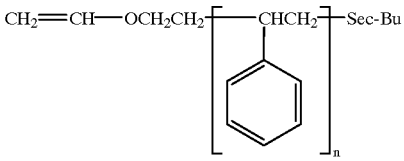

(58)

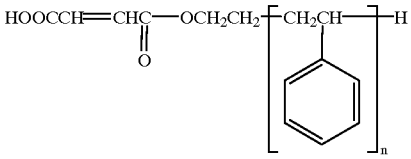

(59)

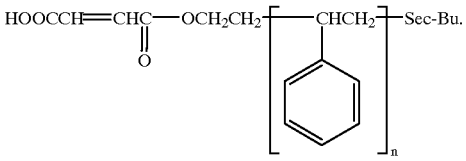

In these macro-monomers, a hydrophilic macro-monomer, especially a polymer obtained by polymerizing methacrylate or acrylate either alone or in combination is preferable for the present invention.

The amount of the macro-monomer is generally 0.01 to 10 percents by weight, preferably 0.03 to 5 percents by weight, more preferably 0.05 to 1 percent by weight, based on the mono-vinyl monomer. If the amount of the macro-monomer is too small, the balance between shelf stability and fixability is not enhanced. If the amount of the macro-monomer is too large, fixability is reduced.

As the polymerization initiator, examples are persulfates such as ammonium persulfate, potassium persulfate; azo compounds such as 4,4-azobis-(4-cyanovaleric acid), 2,2-azobis-(2-amino di-propane) di-hydrochloride, 2,2-azobis-2-methyl-N-1,1-bis(hydroxy methyl)-2-hydroxy ethyl propionamide, 2,2'-azobis-(2,4-dimethylvalrelonitrile), 2,2'-azobis-isobutylonitrile, 1,1'-azobis-(1-cyclohexancarbonitrile); peroxides such as methyl ethyl peroxide, di-t-butyl peroxide, acetyl peroxide, dicumyl peroxide, lauroyl peroxide, benzoyl peroxide, t-butylperoxy-2-ethylhexanoate, di-iso-propylperoxy-dicarbonate, di-t-butylperoxy-isophthalate; and the like. Also, other examples are a red-ox initiator consisting of a combination of the above polymerization initiator with a reducing agent. As these initiators, an oil-soluble radical polymerization initiator, especially an oil-soluble polymerization initiator selected from organic peroxides having a molecular weight of not more than 250 and a temperature at a half-life period of 10 hours that is 40 to 80° C., preferably 45 to 80° C., more especially t-butylperoxy-2-ethylhexanoate, is preferable, because little odor and little environmental disruption due to the presence volatile matter are associated with such an initiator.

The amount of the polymerization initiator is generally 0.1 to 20 parts by weight, preferably 1 to 10 parts by weight, based on 100 parts by weight of the polymerizable monomer component. With an amount less than 0.1 part by weight, the polymerization rate often become slower. With an amount greater than 20 parts by weight, the molecular weight is often undesirably reduced.

As the colorant used in this invention, examples are a dye or pigment such as carbon black, titan white, nigrosine base, aniline blue, chaico oil blue, chrome yellow, ultra marine blue, orient oil red, phthalocyanine blue, malachite green; magnetic particles such as cobalt, nickel, iron sesquioxide, triiron tetraoxide, manganese iron oxide, zinc iron oxide, nickel iron oxide.

As a colorant for a magnetic color toner, examples are C.I. Direct red 1, C.I. Direct red 4, C.I. Acid red 1, C.I. Basic red 1, C.I. Mordant red 30, C.I. Direct blue 1, C.I. Direct blue 2, C.I. Acid blue 9, C.I. Acid blue 15, C.I. Basic blue 3, C.I. Basic blue 5, C.I. Mordant blue 7, C.I. Direct green 6, C.I. Basic green 4, C.I. Basic green 6 and the like. As a pigment, there can be mentioned chrome yellow, cadmium yellow, mineral first yellow, navel yellow, naphtol yellow S, hanseatic yellow G, permanent yellow NCG, turtlazin lake, chrome orange, molybdate orange, permanent orange GTR, pyrazoline orange, benzidine orange G, cadmium red, permanent red 4R, watching red calcium salt, eosin lake, brilliant carmine 3B, manganate violet, first violet B, methyl violet lake, prussian blue, cobalt blue, alkali blue lake, victoria blue lake, phthalocyanine blue, first sky blue, indanthrene blue BC, chrome green, chrome oxide, pigment green B, malachite green lake, final yellow green G.

As a magenta color pigment for a full color toner, examples are C.I. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment violet 19; C.I. Vat red 1, 2, 10, 13, 15, 23, 29, and 35. As a magenta dye, examples are an oil-soluble dye such as C.I. Solvent red 1, 3, 8, 23, 24, 25, 27, 30, 49, 81, 82, 83, 84, 100, 109, and 121; C.I. Disperse red 9; C.I. Solvent violet 8, 13, 14, 21, and 27; C.I. Disperse violet 1; a basic dye such as C.I. Basic red 1, 2, 9, 12, 13, 14, 15, 17, 18, 22, 23, 24, 27, 29, 32, 34, 35, 36, 37, 38, 39, and 40; C.I. Basic violet 1, 3, 7, 10, 14, 15, 21, 25, 26, 27 and 28.

As a cyan color pigment for a full color toner, examples are C.I. Pigment blue 2, 3, 15, 16, and 17; vat blue 6; C.I. Acid blue 45; a copper phthalocyanine dye substituted with 1 to 5 of phthalimide methyl groups into the phthalocyanine structure and the like.

As a yellow color pigment for a full color toner, examples are C.I. Pigment yellow 1, 2, 3, 4, 5, 6, 7, 10, 11, 12, 13, 14, 15, 16, 17, 23, 65, 73, 83, and 138; C.I. Vat yellow 1, 3, and 20.

The amount of these pigment or dye, based on 100 parts by weight of the mono-vinyl monomer, is generally 0.1 to 20 parts by weight, preferably 1 to 10 parts by weight. The amount of a magnetic particle, based on 100 parts by weight of the mono-vinyl monomer, is generally 1 to 100 parts by weight, preferably 5 to 50 parts by weight.

The monomer composition used in the present invention, furthermore, as occasion demands, may comprises additives such as a molecular weight control agent, a surface lubricant, an electric charge control agent and the like.

As the molecular weight control agent, examples are a mercaptan such as t-dodecylmercaptan, n-dodecylmercaptan, n-octylmercaptan; a halogenated hydrocarbon such as carbon tetra-chloride, carbon tetra-bromide. These molecular weight control agents can be charged before or during polymerization. The amount of the molecular weight control agent, based on 100 parts by weight of the polymerizable monomer component, is generally 0.01 to 10 parts by weight, preferably 0.1 to 5 parts by weight.

As the surface lubricant, examples are a low molecular weight polyolefin such as a low molecular weight polyethylene, a low molecular weight polypropylene, a low molecular weight polybutylene and paraffin wax.

The amount of the surface lubricant, based on 100 parts by weight of the polymerizable monomer component, is generally 0.1 to 20 parts by weight, preferably 1 to 10 parts by weight.

Furthermore, for purpose of uniform dispersion of the colorant in the polymerized toner particle, a lubricant such as oleic acid and stearic acid; a dispersion assistant such as a silane coupling agent and titanium coupling agent; and the like can be used. These lubricants or dispersion assistants, based on the weight of the colorant, are generally used in 1/1000 to 1/1 weight proportion.

The electric charge control agent is used to enhance the chargeability of the toner. The electric charge control agent may have either a negative or a positive electric charge. As the electric charge control agent, examples are an organometalic complex having a nitrogen-containing group or carboxyl group, dyes containing metal, nigrosine and the like, more especially 'Bontron N-01' (Nigrosine produced by Orient Chemical Co.), 'Nigrosine Base EX' (produced by Orient Chemical Co.), 'Aizen Spilon black TRH' (produced by Hodogaya Chemical Co.), 'T-77' (produced by Hodogaya Chemical Co.), 'Bontron S-34' (produced by Orient Chemical Co.), 'Bontron E-84' (produced by Orient Chemical Co.), 'Copyblue PR' (produced by Hoechist Co.). The amount of the electric charge control agent, based on 100 parts by weight of the polymerizable monomer component, is generally 0.01 to 10 parts by weight, preferably 0.03 to 5 parts by weight.

The aqueous dispersion of monomer composition used in the present invention can be obtained by mixing uniformly the colorant, the polymerization initiator, the polymerizable monomer component and the like, adding the result monomer composition into an aqueous dispersion medium, and then dispersing the monomer composition in the aqueous dispersion medium.

The method for uniformly mixing these ingredients of the monomer composition is not limited. The most preferable method for dispersing uniformly colorant in the polymerizable monomer component is to mill and disperse the colorant and the like in the polymerizable monomer component with a medium type dispersive apparatus such as ball mill. However the polymerization initiator may be mixed with the colorant and the polymerizable monomer component before dispersing the monomer composition in the aqueous dispersion medium. In that case, the polymerization initiator generates radicals by frictional heat from the dispersing action, and undesirable polymerization is caused, so that the properties of the toner vary widely. Thereupon, the colorant and optionally additives (for example, a charge control agent and the like) other than a polymerization initiator are added to a polymerizable monomer component, and these components are stirred and mixed with means such as a ball-mill to prepare a monomer mixture comprising the individual components dissolved or dispersed uniformly therein. The monomer mixture is poured into the aqueous dispersion medium, and then the polymerization initiator is added to the aqueous dispersion medium with stirring with a mixing machine.

As a mixing machine, a high speed rotative shearing type mixer is preferable, in which the high speed rotative shearing type mixer has a high speed rotatable turbine and a stator having radial baffles, and functions such that the mixture is inhaled from a suction port of the stator under the pressure difference between the upper and bottom of the turbine resulting from high speed rotation, is imparted stress such as shear, impact, cavitation and the like in a high speed rotated turbine, and is extruded through an extrusion port of the stator. Specific examples are "CLEAR MIX" (produced by M. Technique Co., Ltd.) and "EBARA MILDER" (produced by Ebara Co.) and the like.

In this dispersing and mixing step, droplets of the monomer mixture are brought into contact with droplets of the polymerization initiator, so that the droplets of the monomer mixture and the droplets of the polymerization initiator unite with each other, whereby droplets of a monomer composition containing the polymerization initiator, the colorant and the polymerizable monomer component are formed. The time the polymerization initiator is added to the aqueous dispersion medium must be after the monomer mixture is poured and in the course of forming droplets of the monomer mixture. When the polymerization initiator is added after the monomer mixture is formed into fine droplets having desired droplet sizes in the aqueous dispersion medium, the polymerization initiator is difficult to uniformly mix with such droplets. The time the polymerization initiator is added is when the droplet size (volume average droplet size) of the primary droplets formed by the stirring after the pouring of the monomer mixture reaches generally 50 to 1,000 $\mu$m, preferably 100 to 500 $\mu$m though the time varies according to the intended particle size of the resulting toner. When the period of the time from the pouring of the monomer mixture to the addition of the polymerization initiator is long, the formation of the droplets has been completed, so that the monomer mixture is not uniformly mixed with the polymerization initiator, resulting in difficulty in making resin properties such as the polymerization degree and crosslinking degree uniform for every polymerized toner particle. Therefore, the time the polymerization initiator is added is not later than generally 24 hours, preferably 12 hours, more preferably 3 hours after the pouring of the monomer mixture on a large scale such as plant, or not later than generally 5 hours, preferably 3 hours, more preferably 1 hour on a small laboratory scale though it somewhat varies according to reaction scale and the intended particle size of the resulting toner. The temperature of the aqueous dispersion medium between the time the polymerization initiator is added and the subsequent formation of droplets (namely, before initiation of polymerization) is controlled within a range of generally 10 to 40° C., preferably 20 to 30° C. If the temperature is too high, a partial polymerization reaction is started in the dispersion. If the temperature is too low on the other hand, the flowability of the dispersion is reduced when droplets are formed by stirring, resulting in the possibility that formation of the droplets is inhibited. After the droplets of the monomer mixture are brought into contact with the droplets of the polymerization initiator, the stirring is further continued to form secondary droplets of the monomer composition containing the polymerization initiator, the colorant and the polymerizable monomer component, the stirring is further continued to form secondary droplets having desired droplet sizes, and then suspension polymerization of the polymerizable monomer component is then conducted. In the step of forming the secondary droplets, the secondary droplets are finely divided to such an extent that in the subsequent suspension polymerization, a polymerized toner having a volume average particle size of generally about 1 to 50 $\mu$m, preferably about 3 to 30 $\mu$m, more preferably 5 to 30 $\mu$mis formed. The time the secondary droplets are formed can be optionally set according to the nature and added amounts of the polymerizable monomer component, additives, polymerization initiator and the like, the temperature upon the formation of the droplets, the kind of machine used in the formation of the droplets, and desired droplet sizes.

The aqueous dispersion medium may be water, preferably water containing a dispersant.

As the dispersant used in the present invention, examples are a sulfate such as barium sulfate, calcium sulfate; a carbonate such as barium carbonate, calcium carbonate, magnesium carbonate; a phosphate such as calcium phosphate; a metal oxide such as aluminium oxide, titanium oxide; a metal hydroxide such as aluminium hydroxide, magnesium hydroxide, iron hydroxide; a water-soluble polymer such as polyvinylalcohol, methyl cellulose and gelatin; a surfactant such as anionic surfactant, nonionic surfactant and amphoteric surfactant and the like. Among these dispersants, a dispersant comprising a colloid of a water-insoluble metal hydroxide, which can narrow down the distribution of toner particle size, is preferable for enhancing the sharpness of pictures.

The dispersant comprising a colloid of a water-insoluble metal hydroxide is not limited by the manufacturing method thereof. The dispersant comprising a colloid of a water-insoluble metal hydroxide, obtained by bringing to a value of not less than 7 the pH of an aqueous solution of a water-soluble multivalent metal compound, especially a colloid of a water-insoluble metal hydroxide obtained by reacting a water-soluble multivalent metal compound with alkali metal hydroxide in a water phase, is preferable.

Figure 4:
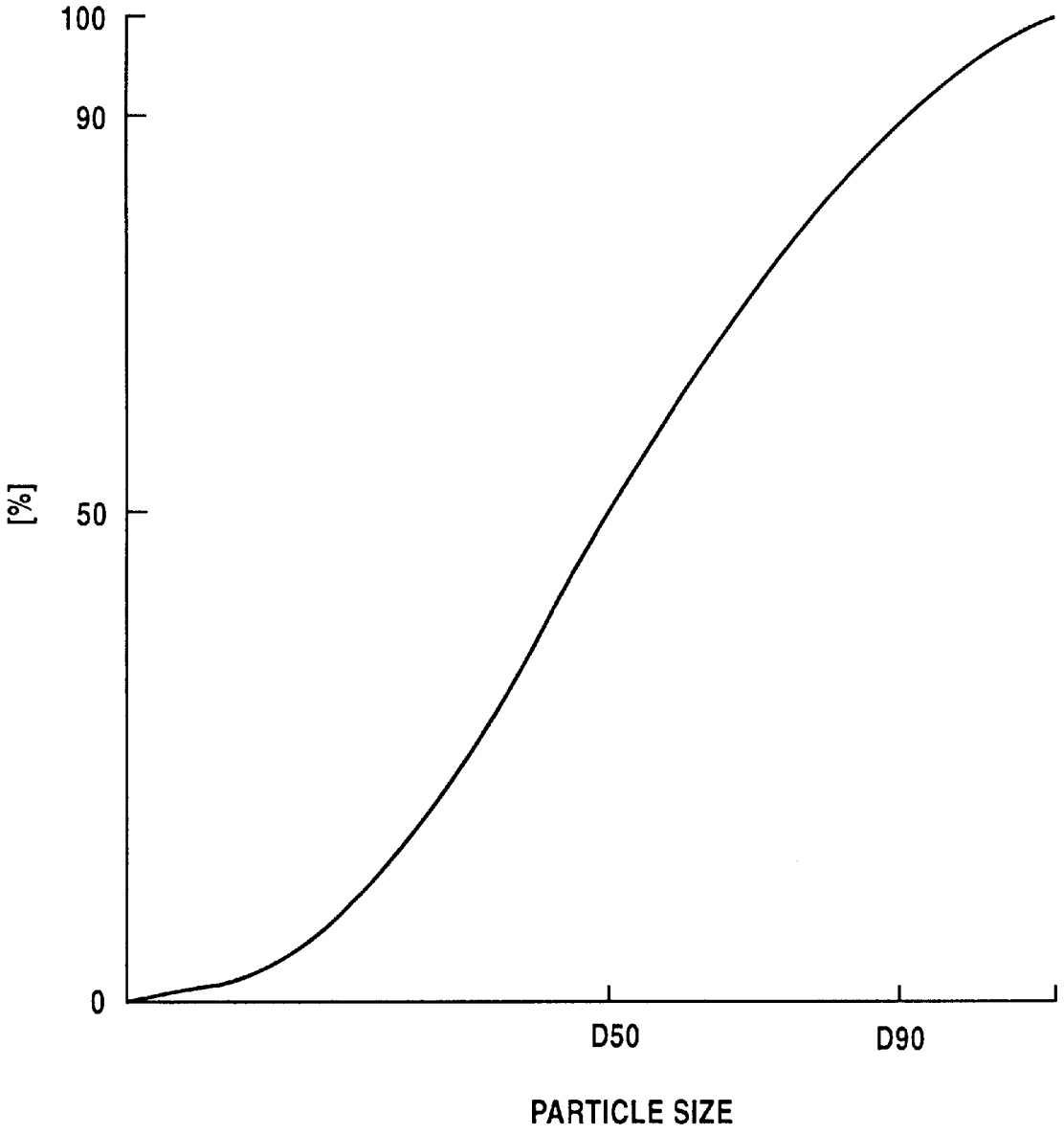
FIG. 4 illustrates an ogive of a particle size.

The colloid of a water-insoluble metal compound used in the present invention which has D50, that is a particle size at 50 percent of the cumulative number distribution of particle size, of not more than 0.5 micrometer and D90, that is a particle size at 90 percent of the cumulative number distribution of particle size, of not more than 1 micrometer is preferable. If the colloid size is too large, the stability of the suspension polymerization declines, and the shelf stability of the toner is reduced. D50 and D90 are determined by an ogive of a particle size as illustlated in FIG. 4 measured with a micro-trac particle size distribution measuring instrument under conditions of measured range of 0.12 to 704 micrometer, measured time of 30 seconds and using ion exchanged water as a medium.

The amount of the dispersant is generally 0.1 to 20 parts by weight based on 100 parts by weight of the mono-vinyl monomer. If the amount of the dispersant is less than 0.1 part by weight, it is difficult to obtain a good polymerization stability. If the amount of the dispersant is more than 20 parts by weight, the viscosity of the aqueous dispersion medium becomes large, and the distribution of toner particle size becomes undesirably wider.

In the process for producing the polymerized toner of this invention, the first step of raising the temperature of the aqueous dispersion of monomer composition to a temperature lower than a target polymerization temperature by about 10° C. to about 40° C. is conducted to initiate the polymerization of the polymerizable monomer component. The second step of raising the temperature of the aqueous dispersion of monomer composition at the rate of about 1° C. to about 20° C. an hour, preferably about 3° C. to about 10° C. an hour, to a temperature lower than the target polymerization temperature by about 5° C. is conducted after the first step. And then the third step of raising the temperature of the aqueous dispersion of monomer composition at the rate of about 3° C. to about 10° C. an hour, preferably about 5° C. to 8° C. an hour, to the target polymerization temperature is conducted. After the third step, the temperature of the aqueous dispersion of monomer composition is kept at the target polymerization temperature until the polymerizable monomer component is completely polymerized. As a result, the polymerized toner has a good balance of shelf stability and fixability.

In a preferable process of this invention, a step of controlling the temperature of the aqueous dispersion of monomer composition within ±5° C. of the target polymerization temperature after reaching a temperature lower than the target polymerization temperature by about 5° C. is further included. The balance of shelf stability and fixability tends to be reduced without this step of controlling.

The method of maintaining this temperature profile of the aqueous dispersion of monomer composition is not limited. For example, the temperature of the jacket may be controlled by the following control method based on the measured temperature of the aqueous dispersion of monomer composition and the like so that temperature of the aqueous dispersion of monomer composition can be transformed following the above temperature profile.

As the method for controlling temperature used in this invention, examples are feed-back control or feed forward control using control algorithm such as P control, PI control, PID control, Optimum control, Fuzzy control, Cascade control and the like.

In the process of this invention, the polymerized toner particle obtained by the above polymerization is dried, and then an outer additive is fixed on the surface of the particle. As the outer additive, examples are inorganic particles, organic particles, preferably silica particles, titanic oxide particles, especially preferably hydrophobic silica particles. In order to bind the outer additive on the polymer particle, generally, the outer additive and the above polymer particles are charged in a mixer such as Henschel mixer and are stirred.

In the polymerized toner obtained by the claimed process, the volume average particle size of the toner particle is generally 1 to 20 micrometer, preferably 2 to 10 micrometer. If the toner particle is too large, resolution of an image is reduced. Also, the ratio of the volume average particle size (hereafter "dv") and the number average particle size (hereafter "dp"), that is dv/dp, is generally not more than 1.7, preferably not more than 1.5.

The polymerized toner obtained by the present process has a toluene insolubility of generally not more than 50 percent by weight, preferably not more than 20 percent by weight, more preferably not more than 10 percent by weight. If toluene insolubility is too large, fixability is reduced. Toluene insolubility is measured by pressure-molding a polymer used for forming a polymerized toner, placing the molded polymer in a cage made of an 80-mesh net, dipping the cage in toluene for 24 hours at room temperature, drying the residual solid in the cage, measuring the weight thereof, and calculating the toluene insolubility as the percentage of the solid based on the weight of the molded polymer.

The polymerized toner obtained by the present process has a ratio of major axis (hereafter "rl") and minor axis (hereafter "rs"), that is rl/rs, being generally 1 to 1.2, preferably 1 to 1.1. If this ratio is too large, resolution of image is reduced and durability tends to be reduced, since toner particles undergo larger friction with each other and the outer additive falls off while the toner is in the toner housing of a visible image forming apparatus.

With the polymerized toner obtained by the present process, the fixing temperature can be reduced to a relatively very low temperature of 80 to 180 degrees centigrade, preferably 100 to 150 degrees centigrade; moreover the toner particles do not aggregate in storage, and shelf stability is excellent. Also, since the amount of static charge of the toner is not reduced under conditions of high temperature and high humidity, fogging and reduction of printing density can be prevented.

The invention will now be described specifically by the following examples that by no means limit the scope of the invention. In the examples parts or % are by weight unless otherwise specified.

The properties were determined by the following methods.

(1) Particle size of toner

The volume average particle size and number average particle size were measured with a Coulter multi-sizer (produced by Coulter Electric Co.) under conditions of 100 micrometer of aperture, Isoton II as a medium, 10% as concentration, and 50,000 as the number of the measured particles. The spread of particle size was represented by the ratio (dv/dp) of volume average particle size to number average particle size.

(2) Form of toner

A picture of the polymerized toner was taken with a scanning electron microscope, was read into a picture analyzer to measure rl/rs wherein rl is major axis and rs is minor axis. The number of the measured toner particles was 100.

(3) Resistivity of toner

Resistivity of the toner was measured with a dielectric loss measuring instrument (TRS-10 trade name, produced by Andou Electric Co.) at a temperature of 30 degrees centigrade, and a frequency of 1 kHz.

(4) The amount of electric charge of toner

The amount of electric charge was measured under L/L conditions (temperature of 10 degrees centigrade, and humidity of 20% RH), or H/H conditions (temperature of 35 degrees centigrade, and humidity of 80% RH).

The toner was set in a 4-sheets/min printer under the above conditions. After one day, five sheets having a half-tone printing pattern were printed. Toner on the developing roll was aspirated with an aspiration electric charge amount measuring instrument, and the amount of electric charge based on the weight of toner was determined from a correlation of electric charge and aspiration.

(5) Quality of printing image

Continuous printing was carried out with the above printer. Quality of the printing image was evaluated by the following index.

A: not less than ten thousand sheets having printing density of not less than 1.3, as measured with a reflecting image density measuring instrument (produced by Macbeth Co.), and fog on non-picture portion of not more than 10%, as measured with a white colorimetry measuring instrument, can be obtained.

B: not less than 5 thousand sheets to less than ten thousand sheets having printing density of not less than 1.3, as measured with a reflecting image density measuring instrument, and fog on non-picture portion of not more than 10%, as measured with a white colorimetry measuring instrument, can be obtained.

C: less than 5 thousand sheets having printing density of not less than 1.3, as measured with a reflecting image density measuring instrument, and fog on non-picture portion of not more than 10%, as measured with a white colorimetry measuring instrument, can be obtained.

(6) Distribution of melt index (MI) of toner

Melt index of 5 g toner was measured three times a batch with Melt-Indexer at a measuring temperature of 150° C. and a load of 10 kgf and each average MI of 5 batches was calculated.

The proportion (σ/Av) between a standard deviation and average MI of 5 batches was calculated to evaluate the distribution of MI. A lesser proportion is more preferable.

(7) Distribution of Shelf stability of toner

The toner was placed into a box, the box was made airtight, and the box was sunk in a constant-temperature water bath of 55 degrees centigrade for 8 hours. After that, the toner was taken out from the box and was placed on a 42-mesh sieve, keeping the aggregated toner structure from breaking. The sieve was vibrated with a powder measuring instrument ('Powder Tester' trade name; produced by Hosokawa Micron Co.) under a vibration intensity of 4.5 for 30 seconds. The weight of toner which did not pass through the sieve was measured. Aggregation (% by weight) of toner was determined from the weight of the toner which did not pass through and the total weight of toner used in this test. The above evaluation test was carried out three times a batch, each average aggregation of 5 batches was calculated.

The proportion (σ/Av) between a standard deviation and average aggregation of 5 batches was calculated to evaluate the distribution of shelf stability of toner.

(8) Distribution of Fixability of toner

Printing all over (i.e., to cover the entire surface of a sheet) was carried out with a non-magnetic one-component developing system printer having a variable fixing roll temperature. The image density (IDO) of the sheet printed all over was measured with a reflecting image density measuring instrument (produced by Macbeth Co.). Adhesive tape (Scotch mending tape 810-3-18, produced by Sumitomo 3M Co.) was placed on the sheet printed all over, was pressed on the sheet at 500 g weights of a sheet roll, and was peeled off at a uniform rate in parallel to the sheet. After that, the image density (ID1) of the sheet was measured with the reflecting image density measuring instrument. Fixability was determined by the following formula.

Fixability (%)=(ID1 /IDO)·100

The correlation between the fixability and the fixing roll temperature was obtained. The fixing temperature was defined as a fixing roll temperature giving a fixability of 80%.

The above evaluation test was carried out three times a batch, each average fixing temperature of 5 batches was calculated.

The proportion (σ/Av) between a standard deviation and average fixing temperature of 5 batches was calculated to evaluate the distribution of Fixability of toner.

EXAMPLE 1

Into a beads mill, 90 parts of styrene and 10 parts of a surface lubricant (FT-100, produced by Shell•MSD Co.) were charged, and the surface lubricant was dispersed to obtain a surface lubricant styrene dispersion having an average particle size of 2 micrometer.

In a beads mill, 67 parts of styrene, 15 parts of n-butyl acrylate, 0.3 part of divinyl benzene, 20 parts of the surface lubricant styrene dispersion obtained as the above, in which the surface lubricant styrene dispersion consists of 18 parts of styrene and 2 parts of a surface lubricant, 7 parts of carbon black ('Monark 120' trade name; produced by Cabot Co.) and 1 part of charge control agent ('Aizen Spilon Black TRH' trade name, produced by HODOGAYA Chemical Co.) were dispersed at room temperature to obtain a monomer mixture.

On the other hand, into an aqueous solution obtained by dissolving 9.8 parts of magnesium chloride in 250 parts of ion exchanged water, an aqueous solution obtained by dissolving 6.9 parts of sodium hydroxide in 50 parts of ion exchanged water was slowly added to obtain a dispersion of magnesium hydroxide colloid, that is, a water-insoluble metal hydroxide colloid. The ogive of the above colloid size was measured with a micro-trac particle size distribution measuring instrument under conditions of measured range of 0.12 to 704 micrometer, measured time of 30 seconds and using ion exchanged water as a medium. D50, that is the particle size at 50 percent of the cumulative number distribution of particle size, was 0.38 micrometer. D90, that is the particle size at 90 percent of the cumulative number distribution of particle size, was 0.82 micrometer.

Into the above dispersion of magnesium hydroxide colloid, the above monomer mixture was added and was stirred at a low speed agitator. And then 5 parts of t-butyl peroxy-2-ethylhexanoate was added and was stirred for 2 to 3 minutes at a low speed agitator to obtain an aqueous dispersion of monomer composition.

Into a high speed rotative shearing type mixer ("CLEAR MIX CLM-0.8S" produced by M. Technique Co., Ltd.) having a pressure vacuum attachment of 500 cc, rotor (ROTOR R-2) rotated by 21,000 rpm and stator (screen S-1.0-24), in which clearance between the rotor and the stator is 0.2 mm, the above aqueous dispersion of monomer composition was processed at 30 kg/hr with a pump to form droplets of the composition. The resulting droplets were characterized by a volume average droplet size of about 5.0 micrometer, a proportion between a volume average droplet size and a number average droplet size of about 1.25, and an existence probability within a volume average droplet size ±1 micrometer of about 65 volume %.

The obtained aqueous dispersion of monomer composition was charged in a polymerization reactor with agitator. The obtained aqueous dispersion of monomer composition was raised from room-temperature to 80 degrees centigrade at an average rate of 50° C./hr, from 80 to 85° C. at an average rate of 10° C./hr, from 85 to 89° C. at an average rate of 7° C./hr, and was held at the target polymerization temperature of 90° C. This temperature profile is shown in FIG. 1, in which a dotted line is the profile of measured temperature, a solid line is the target profile, and "1" in a horizontal axis means the point at more than 80 degrees centigrade.

This profile of temperature was actualized by controlling the jacket temperature by a cascade control method and the like based on the temperature measured on the jacket and measured inside of the polymerization reactor. After reaching 90° C., the temperature of the dispersion was changed within range of 88° C. to 91° C. After completing the polymerization reaction, the aqueous dispersion was cooled to obtain a dispersion of polymer particles for toner.

The aqueous dispersion of polymer particles was brought to a pH of not more than 4 by sulfuric acid, was washed at 25 degrees centigrade for 10 minutes, was dehydrated by filtration, was reslurried by adding 500 parts of ion exchanged water to rinse. After the last dehydration, the dehydrated solid was placed in a dryer having 45 degrees centigrade temperature for 48 hours to obtain polymer particles.

To 100 parts of the above polymer particles, 0.6 part of hydrophobic colloidal silica ('R-202' Trade name, Degussa AG) was added and was mixed with a Henschel mixer to make a polymerized toner.

The above process for producing the polymerized toner was repeated 5 times.

The resistivity of the fifth polymerized toner obtained by the above process was 11.5 (logωcm). Also, the volume average particle size was 6.9 micrometer, the proportion of volume average particle size and number average particle size was 1.27, and rl/rs was 1.1. In the image evaluation, printing density was high, fog or patches were not found, and an image having an excellent resolution and a good color tone could be obtained (Rating A). The other evaluations are shown in table 1.

TABLE 1

| | Example 1 | Comparative Example 1 | Comparative Example 2 |
|---|---|---|---|
| Evaluation of 5th polymerized toner | | | |
| dv [μm] | 6.9 | 6.7 | 7.0 |
| dv/dp | 1.27 | 1.25 | 1.28 |
| rl/rs | 1.1 | 1.1 | 1.1 |
| Resistivity [logΩcm] | 11.5 | 11.4 | 11.6 |
| Amount of electric charge | | | |
| L/L [μc/g] | 25.3 | 26.5 | 24.3 |
| H/H [μc/g] | 21.5 | 22.6 | 25.8 |
| Quality of printing image | A | B | B |
| Melt Index | | | |
| 1st | 5.2 | 25 | 0.7 |
| 2nd | 8.3 | 38 | 0.3 |
| 3rd | 7.5 | 52 | 0.4 |
| 4th | 6.8 | 26 | 0.3 |
| 5th | 5.8 | 13 | 0.5 |
| Average (Av) | 6.7 | 30.8 | 0.4 |
| Standard deviation (σ) | 1.25 | 14.8 | 0.17 |
| σ/Av | 0.19 | 0.48 | 0.43 |
| Shelf stability [%] | | | |
| 1st | 1.0 | 50 | 0.8 |
| 2nd | 1.0 | 32 | 1.0 |
| 3rd | 0.8 | 22 | 0.6 |
| 4th | 1.2 | 16 | 0.4 |
| 5th | 0.8 | 5 | 0.8 |
| Average (Av) | 0.96 | 25.0 | 0.72 |
| Standard deviation (σ) | 0.17 | 17.1 | 0.21 |
| σ/Av | 0.18 | 0.68 | 0.32 |
| Evaluation rating | A | C | A |
| Fixability [° C.] | | | |
| 1st | 140 | 100 | 150 |
| 2nd | 130 | 150 | 160 |
| 3rd | 140 | 110 | 150 |
| 4th | 141 | 140 | 160 |
| 5th | 130 | 130 | 170 |
| Average (Av) | 136 | 126 | 158 |
| Standard deviation (σ) | 5.5 | 20.7 | 8.4 |
| σ/Av | 0.04 | 0.16 | 0.05 |
| Evaluation rating | A | A | C |

(Comparative Example 1)

Figure 2:
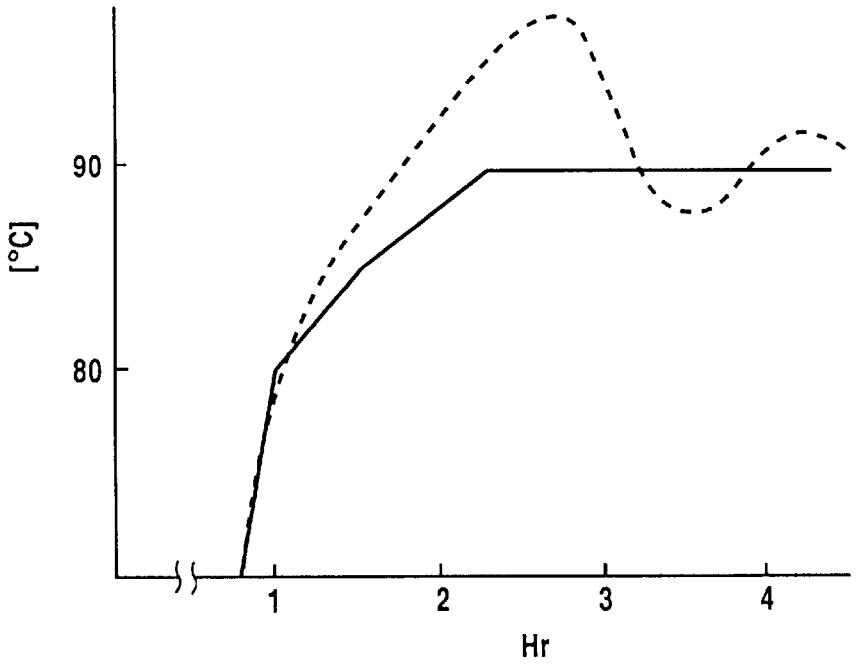
FIG. 2 illustrates a temperature profile of an aqueous dispersion of monomer composition at the 5th batch of Comparative Example 1.

A polymerized toner was made by the same process as described in Example 1 except that the aqueous dispersion of monomer composition was heated by raising the jacket temperature from room temperature to 90° C. in one stretch during polymerization. This profile of temperature is shown in FIG. 2, in which a dotted line is the profile of measured temperature, a solid line is the target profile , and "1" in a horizontal axis means the point at more than about 80 degrees centigrade. After reaching 85° C., the temperature of the dispersion was raised at an average rate of about 15° C./hr, After reaching 90° C., the temperature of the dispersion reached 98° C. as the top point, and was changed to within a range of 88° C. to 95° C. after that. It took 1.5 hours to stabilize the temperature of the dispersion to about 90° C. In the image evaluations, offset was found, and the image was not good (Rating B). The other evaluations are shown in table 1.

(Comparative Example 2)

Figure 3:
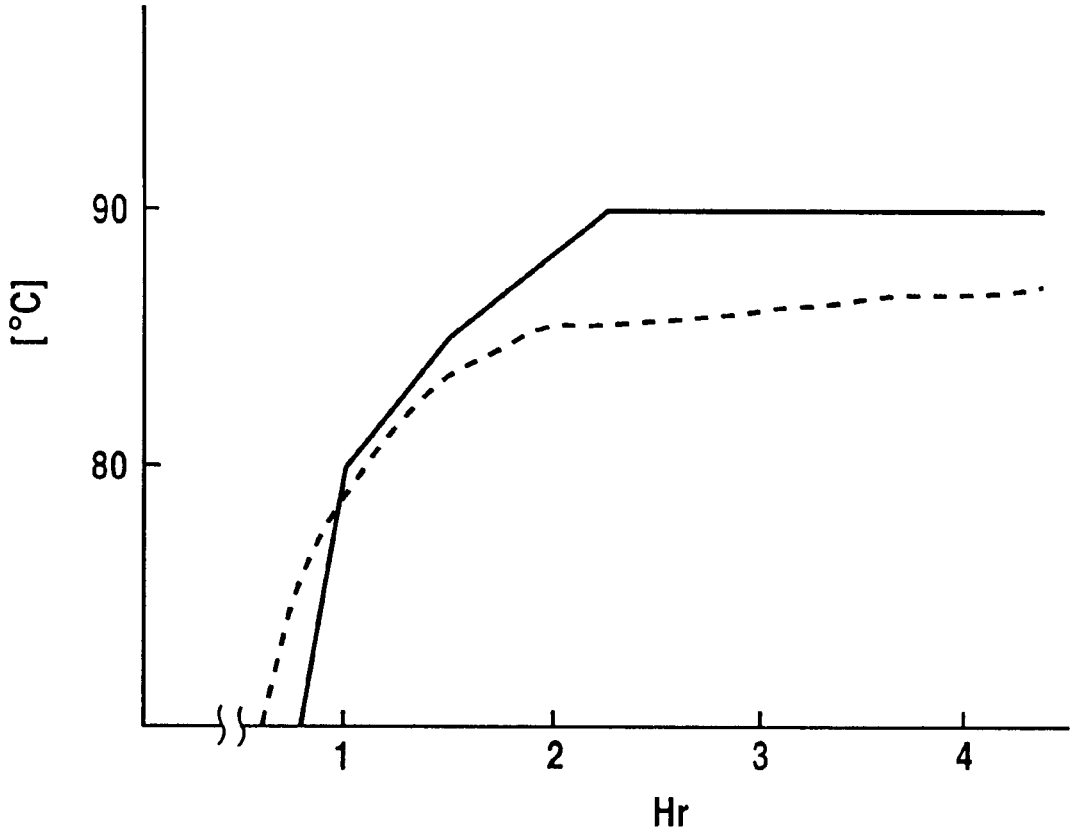
FIG. 3 illustrates a temperature profile of an aqueous dispersion of monomer composition at the 5th batch of Comparative Example 2.

A polymerized toner was made by the same process as described in Example 1 except that the aqueous dispersion of monomer composition was heated by raising slowly the jacket temperature from room temperature to 90° C., during polymerization. This profile of temperature is shown in FIG. 3, in which a dotted line is the profile of measured temperature, a solid line is the target profile, and "1" in a horizontal axis means the point at more than about 80 degrees centigrade. After reaching 85° C., the temperature of the dispersion was raised at average rate of about 1° C./hr. It took about 5 hours to reach about 90° C. After reaching 90° C., the temperature of the dispersion was changed to within a range of 89° C. to 91° C. In the image evaluations, fixability was bad and the image was not good (Rating B). The other evaluations are shown in table 1.

The process of the present invention produces stably a polymerized toner having excellent balance of shelf stability and fixability, and having a low melt index of the polymer constituting the toner. Consequently, a high resolution visible image can be formed by high speed for many hours. Also the image is excellent.

We claim:

1. A process for producing a polymerized toner comprising the steps of:

raising the temperature of an aqueous dispersion of monomer composition, in which the monomer composition comprises a colorant, a polymerization initiator and a polymerizable monomer component, to a temperature lower than a target polymerization temperature by about 10 to about 40° C., then raising the temperature of the aqueous dispersion of monomer composition at the rate of about 1° C. to about 20° C. an hour to a temperature lower than the target polymerization temperature by about 5° C., and then raising the temperature of the aqueous dispersion of monomer composition at the rate of about 3° C. to about 10° C. an hour to the target polymerization temperature, whereby the polymerizable monomer component is polymerized.

2. The process for producing the polymerized toner according to claim 1, which further comprises a step of controlling the temperature of the aqueous dispersion of monomer composition within ±5° C. of the target polymerization temperature after reaching a temperature lower than the target polymerization temperature by about 5° C.

3. The process for producing the polymerized toner according to claim 1, in which the polymerization is carried out in the presence of a dispersant.

4. The process for producing the polymerized toner according to claim 3, in which the dispersant comprises a colloid of a water-insoluble metal hydroxide.

5. The process for producing the polymerized toner according to claim 3, in which the dispersant comprises a colloid of a water-insoluble metal hydroxide having a particle size at 50 percent of the cumulative number distribution of particle size of not more than 0.5 micrometer, and having a particle size at 90 percent of the cumulative number distribution of particle size of not more than 1 micrometer.

6. The process for producing the polymerized toner according to claim 3, in which the dispersant comprises a colloid of a water-insoluble metal hydroxide, obtained by bringing to a value of not less than 7 the pH of an aqueous solution of a water-soluble multivalent metal compound.

7. The process for producing the polymerized toner according to claim 3, in which the dispersant comprises a colloid of a water-insoluble metal hydroxide, obtained by reacting a water-soluble multivalent metal compound with an alkali metal hydroxide in a water phase.

8. The process for producing the polymerized toner according to claim 1, in which the polymerizable monomer component contains at least one mono-vinyl monomer and at least one crosslinkable monomer.

9. The process for producing the polymerized toner according to claim 1, in which the polymerizable monomer component contains at least one mono-vinyl monomer, at least one crosslinkable monomer and at least one macro-monomer.

10. The process for producing the polymerized toner according to claim 8, in which the mono-vinyl monomer is selected from the group consisting of styrene, acrylic acid, methacrylic acid, and a derivative thereof.

11. The process for producing the polymerized toner according to claim 8, in which the mono-vinyl monomer is a mixture of styrene and n-butyl acrylate, a mixture of styrene and 2-ethyl hexyl acrylate, or a mixture of styrene, n-butyl acrylate and 2-ethyl hexyl acrylate.

12. The process for producing the polymerized toner according to claim 9, in which the macro-monomer has an acrylyl group or a methacrylyl group at the end of the molecular chain.

13. The process for producing the polymerized toner according to claim 9, in which the macro-monomer is a polymer or a copolymer of methacrylate or acrylate.

14. The process for producing the polymerized toner according to claim 9, in which the macro-monomer has a molecular weight of about 1,000 to about 30,000.

15. The process for producing the polymerized toner according to claim 9, the amount of the macro-monomer is 0.01 to 10 parts by weight based on 100 parts by weight of the mono-vinyl monomer.

16. The process for producing the polymerized toner according to claim 1, in which the polymerization initiator is an oil-soluble radical polymerization initiator.

17. The process for producing the polymerized toner according to claim 16, in which the oil-soluble radical polymerization initiator is an organic peroxide having a molecular weight of not more than 250 and a temperature of a half-life period of 10 hours of 40 to 80 degrees centigrade.

18. The process for producing the polymerized toner according to claim 1, in which the polymerization initiator is t-butyl peroxy-2-ethylhexanoate.

19. A process for producing a polymerized toner comprising the steps of:

raising the temperature of an aqueous dispersion of monomer composition to a temperature lower than a target polymerization temperature by about 10° C. to about 40° C., in which the monomer composition comprises a colorant, a polymerization initiator and a polymerizable monomer component, then raising the temperature of the aqueous dispersion at the rate of about 3 ° C. to about 10° C. an hour to a temperature lower than the target polymerization temperature by about 5° C., and then raising the temperature of the aqueous dispersion at the rate of about 5° C. to about 8° C. an hour to the target polymerization temperature, whereby the polymerizable monomer component is polymerized.

20. The process for producing the polymerized toner according to claim 1, in which the aqueous dispersion of monomer composition is obtained by dispersing a monomer mixture containing the polymerizable monomer component and the colorant in the absence of an oil-soluble polymerization initiator in an aqueous dispersion medium containing the dispersant, then adding the oil-soluble polymerization initiator to the dispersion of the monomer mixture while stirring the dispersion of the monomer mixture to form primary droplets of the monomer mixture, thereby bringing the primary droplets into contact with droplets of the oil-soluble polymerization initiator to form secondary droplets of the monomer composition containing the oil-soluble polymerization initiator, the polymerizable monomer component and the colorant, and further conducting the stirring to form secondary droplets having desired droplets sizes.

* * * * *